US005174728A

United States Patent [19]

Kimura et al.

[11] Patent Number: 5,174,728

[45] Date of Patent: Dec. 29, 1992

[54] VARIABLE CAPACITY SWASH PLATE TYPE COMPRESSOR

[75] Inventors: Kazuya Kimura; Hiroaki Kayukawa, both of Kariya, Japan

[73] Assignee: Kabushiki Kaisha Toyoda Jidoshokki Seisakusho, Kariya, Japan

[21] Appl. No.: 842,062

[22] Filed: Feb. 26, 1992

[30] Foreign Application Priority Data

Mar. 8, 1991 [JP] Japan ..... 3-13020[U]

[51] Int. Cl.[5] ..... F04B 1/28; F04B 21/04

[52] U.S. Cl. ..... 417/222.2; 92/71; 92/159; 92/160; 92/162 P; 417/269

[58] Field of Search ..... 92/162 P, 181 R, 181 P, 92/159, 160, 82, 12.2, 71; 417/222 S, 269, 270, 222 R; 91/499, 504, 506, 505; 184/6.17

[56] References Cited

U.S. PATENT DOCUMENTS

| | | | |
|---|---|---|---|
| 1,231,615 | 7/1917 | Jones | 92/159 |
| 1,517,386 | 12/1924 | Almen | 92/71 X |
| 2,048,272 | 7/1936 | Linthicum | 92/12.2 X |
| 2,570,843 | 10/1951 | Orshansky, Jr. | 92/12.2 X |
| 2,722,889 | 11/1955 | Wailmark | 91/499 X |
| 3,035,879 | 5/1962 | Hanny et al. | 92/181 R X |
| 3,165,892 | 1/1965 | Roberts | 91/499 X |
| 4,664,604 | 5/1987 | Terauchi | 417/222 S |

FOREIGN PATENT DOCUMENTS

| | | | |
|---|---|---|---|
| 1298869 | 6/1962 | France | 92/181 R |
| 65180 | 3/1988 | Japan | 417/269 |
| 253183 | 10/1988 | Japan | 417/269 |

*Primary Examiner*—Leonard E. Smith

*Attorney, Agent, or Firm*—Brooks Haidt Haffner & Delahunty

[57] ABSTRACT

A variable capacity swash plate type refrigerant compressor having a plurality of pistons each including a cylindrical hollow main body reciprocated in a cylinder bore of a cylinder block, and an engaging portion engaged with a swash plate. The cylindrical hollow main body of the piston is provided with at least one first through-bore for providing a communication between the interior of the main body and the cylinder bore, and at least one second through-bore for providing a communication between the interior of the piston main body and a crank chamber of the compressor to thus enable the piston to have a thin and light weight wall construction, and to have a sufficient durability against large pressure changes applied to the piston.

2 Claims, 4 Drawing Sheets

VARIABLE CAPACITY SWASH PLATE TYPE COMPRESSOR

BACKGROUND OF THE INVENTION

1. Field of the Invention

The present invention relates to a variable capacity swash plate type compressor able to be accommodated in an air-conditioner for a car, and more particularly, relates to a construction of a piston to be assembled in such a variable capacity swash plate type compressor.

2. Description of the Related Art

A typical conventional variable capacity swash plate type compressor is disclosed in Japanese Unexamined (Kokai) Patent publication No. 60-175783 published on Sep. 9, 1985, by the Japanese Patent Office.

FIG. 6 illustrates a compressor corresponding to the compressor of this publication. The compressor of FIG. 6 has a cylinder block 2 encased in a cylindrical shell 2*a*, and provided with a plurality of cylinder bores 21. The cylindrical shell 2*a* defines a closed crank chamber 31 therein, located axially in front of an inner end of the cylinder block. The crank chamber 31 is closed by a front housing 3 holding a radial bearing, to support an outer portion of a drive shaft 5, and rear ends of the cylinder block 2 and the cylindrical shell 2*a* are commonly closed by a rear housing 4 via a valve plate 41. The rear housing 4 is provided with an annularly extended suction chamber 42, and a cylindrical discharge chamber 44, which are communicated with the plurality of cylinder bores 21 of the cylinder block 2. The cylinder block 2 is centrally formed with a shaft bore, in which a radial bearing is seated, to rotatably support an inner end of the shaft 5. The drive shaft 5 has a central portion thereof on which a swash plate 6 is mounted, to be rotated with the shaft 5, about the axis of the drive shaft 5 within the crank chamber 31. The swash plate 6 is also able to wobble about an axis perpendicular to the axis of the drive shaft 5. An outer peripheral portion of the swash plate 6 is engaged, via spherical shoes 7, with pistons 1 slidably fitted in the cylinder bores 1 of the cylinder block. The cylinder block 2 is provided with a passageway 23 providing a fluid communication between the crank chamber 31 and the suction chamber 42 when a bellows-operated valve 8 is retracted from a passage-closed position to a passage-open position as shown in FIG. 6. The bellows-operated valve 8 operates in response to a change in a pressure differential between a preset pressure of the bellows and a suction pressure of the compressor.

When the drive shaft 5 is rotated together with swash plate 6, the pistons 1 reciprocate in the respective cylinder bores 21 to pump a refrigerant gas from the suction chamber 42 into the cylinder bores 21, and to discharge the refrigerant ga after compression from the cylinder bores 21 toward the discharge chamber 44. The volume or capacity of the compressed refrigerant gas discharged toward the discharge chamber 44 depends on a pressure prevailing in the crank chamber 31, which pressure is adjustably changed by the bellows-operated valve 8 controlling an extent of the fluid communication between the crank chamber 31 and the suction chamber 42. Namely, when the suction pressure is higher than the preset pressure of the bellows of the bellows-operated valve 8, the valve 8 is retracted to the passage-open position thereof, and therefore, the passageway 23 provides a required fluid communication between the crank chamber 31 and the suction chamber 42 to thus lower the pressure in the crank chamber 31. Accordingly, the stroke of each piston 1 and an inclination of the swash plate 6 from an erect position thereof are increased, to thereby increase the compression capacity of the compressor. Conversely, when the suction pressure is lower than the preset pressure of the bellows of the bellows-operated valve 8, the valve 8 is moved to the passage-closed position in which the passageway 23 does not provide a fluid communication between the crank chamber 31 and the suction chamber 42, and therefore, the pressure within the crank chamber 31 is raised to thereby decrease the stroke of each piston 1 and the inclination of the swash plate 6, and thus the compression capacity of the compressor is lowered.

During the compression operation of the compressor, a part of the compressed refrigerant gas always leaks from the cylinder bores 21 into the crank chamber 31, and therefore, this leaking refrigerant gas is able to act as a lubricant for all moving parts of the compressor, i.e., the swash plate 6 and the shoes 7.

With the above-described variable capacity swash plate type compressor, the pistons 1 preferably has a light weight, from the viewpoint of a reduction of a load applied to a drive source of the compressor, e.g., a car engine. Accordingly, as shown in FIG. 6, a main body of each piston 1, i.e., a cylindrical portion of each piston 1 reciprocating in the cylinder bore 21, is formed with an open space therein, and a protrusion thereof is axially extended from the main body to be engaged with a radial aperture at the periphery of the swash plate 6 via the shoes 7. Nevertheless, since the reciprocatory motion of each piston 1 in the cylinder bore 21 is caused by the rotating motion of the swash plate 6, an unfavorable force is applied by the rotating swash plate 6 on each piston 1, in a direction substantially corresponding to the direction of rotation of the swash plate 6. Accordingly, the axial protrusion of the piston engaged with the swash plate 6 and the shoes 7 must be able to physically withstand such an unfavorable force. Taking this into consideration, an improvement of the piston 1 shown in FIG. 6 can be made by constructing a reciprocating piston in a manner such that a main body thereof has the shape of a closed hollow thin wall cylinder. Namely, the closed hollow cylinder construction of the main body of each piston enable the providing of an axial protrusion thereof from the main body, physically able to withstand the afore-mentioned unfavorable force acting on the piston, and having a sufficiently light weight.

Nevertheless, the production of the piston having the closed hollow cylindrical body requires a particular fabrication such that at least two separate cylindrical hollow elements are joined together by welding, and therefore, when joined, the closed hollow cylindrical body of the piston sealingly contains air at an approximately atmospheric pressure therein.

When the above-mentioned type of pistons are accommodated in a variable capacity swash plate type compressor, and when a refrigerant gas at a high pressure 4 to 5 times higher than the atmospheric pressure is filled in a refrigerating circuit incorporating the compressor therein, a large pressure differential must appear between the pressure of the refrigerant gas and the pressure within the main body of each piston. Furthermore, a larger pressure differential is produced between a pressure in the cylinder bores, wherein an increase and a decrease of the pressure are repeated in response to the compression and suction of the refrigerant gas, and a pressure of the interior of each piston during the reciprocating operation of the pistons. As a result, a large variable pressure acts on the respective pistons and causes a deformation of the main body of each piston having a thin wall, during the reciprocation of the pistons. Further, when the pistons are subjected to such a large variable pressure, the welded portion of the main body of the piston is apt to be broken, and if broken, the air emerges from the interior of the main body of the piston and is mixed with the refrigerant gas, and such a mixture of air and refrigerant gas has an adverse affect on the operation of the compressor. Therefore, when a piston having a closed hollow cylindrical body is employed in a variable capacity type refrigerant compressor, the wall thickness of the main body of the piston cannot be thinner than a given limit, and thus a sufficient reduction in the weight of the piston cannot be obtained.

SUMMARY OF THE INVENTION

Therefore, an object of the present invention is to provide a light weight piston exhibiting a required physical strength when used in a variable capacity swash plate type refrigerant compressor.

Another object of the present invention is to improve the construction of a piston accommodated in a variable capacity swash plate type refrigerant compressor, to thereby provide the piston with a prolonged operating life.

In accordance with the present invention, there is provided a variable capacity swash plate type refrigerant compressor provided with an axially extended cylinder block having front and rear ends thereof and a plurality of axial cylinder bores formed therein, a front housing connected to the front end of the cylinder block and defining a sealed crank chamber therein extending in front of the front end of the cylinder block, a rear housing connected to the rear end of the cylinder block and defining therein a suction chamber for a refrigerant gas before compression and a discharge chamber for the refrigerant gas after compression, a drive shaft rotatably held by the cylinder block and the front housing so that an axis thereof is axially extended through the crank chamber, a generally circular-shape swash plate mounted on the drive shaft to be rotatable therewith within the crank chamber and to be capable of turning about an axis perpendicular to the axis of the drive shaft, a plurality of reciprocatory pistons fitted in the cylinder bores of the cylinder block and engaged with the swash plate via shoes, and a valve means for adjusting a fluid communication between the crank chamber and the suction chamber to thereby control a capacity of the compressor by changing a pressure differential between the said crank and suction chambers, wherein each of said plurality of reciprocatory pistons comprises:

a cylindrical main body including an axially extended cylindrical wall member, a first end closing one axial end of the cylindrical wall member and acting as a compression end face of the reciprocatory piston, and a second end closing the other axial end of the cylindrical wall member and constantly facing the crank chamber, the cylindrical main body having a void therein, at least one first through-bore radially formed in the cylindrical wall member for providing a constant communication between the closed void and one of the plurality of cylinder bores in which the piston is fitted, and at least one second through-bore axially formed in the second end of the cylindrical wall member for providing a constant communication between the closed void and the crank chamber; and an engaging portion axially extended from the cylindrical main body and defining a recess for receiving a periphery of the circular swash plate and the shoes.

The first through-bores of the piston can provide a fluid communication between the closed void of the cylindrical main body of the piston and the corresponding cylinder bore in which the piston reciprocates, and the second through-bore can provide a constant fluid communication between the closed void of the cylindrical main body of the piston and the crank chamber. Therefore, when the compressor is at a standstill, a pressure level of the closed void of the piston is maintained at a level equal to that prevailing in the interior of the compressor. When the compressor is operated to reciprocate the pistons, however, a pressure level of the closed void of each piston can be varied in direct response to a change in a pressure level of the corresponding cylinder bore, which pressure level changes from a high pressure level to a low pressure level, and vice versa, in accordance with the reciprocation of the piston, and thus the thickness of the cylindrical wall member of the cylindrical main body of each piston can be thin, to thereby reduce the weight of each of the pistons. It will be understood from the foregoing that the number and extent of each of the above-mentioned first and second through-bores of the piston may be selectively chosen as required.

BRIEF DESCRIPTION OF THE DRAWINGS

The above and other objects, features and advantages of the invention will be made apparent from the ensuing description of a preferred embodiment thereof, with reference to the accompanying drawings wherein.

DESCRIPTION OF THE PREFERRED EMBODIMENT

Figure 5:
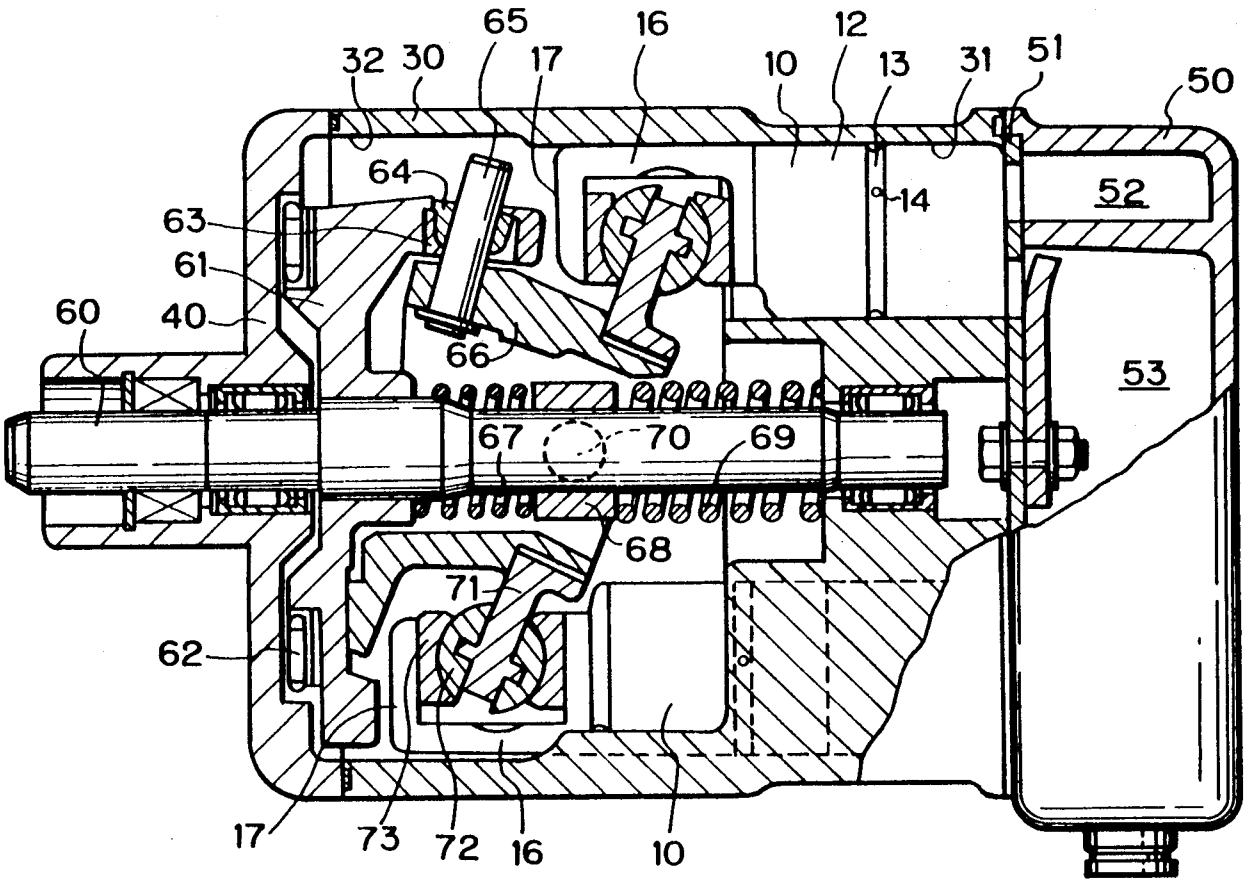
FIG. 5 is a longitudinal cross-sectional view of a variable capacity swash plate type compressor according to an embodiment of the present invention.

Referring to FIG. 5, a variable capacity swash plate type compressor according to the present invention includes a cylinder block 30 having a plurality of cylinder bores 31 in which a plurality of pistons 10 is fitted to be reciprocated. A front end, i.e., a left-hand end in FIG. 5, of the cylinder block 30 is closed by a front housing 40 to define a closed cylindrical crank chamber 32 therein. A rear end, i.e., a right-hand end in FIG. 5, of the cylinder block 30 is closed by a rear housing 50 via a valve plate 51. The rear housing 50 is provided with a suction chamber 52 for a refrigerant gas before compression and a discharge chamber 53 for a refrigerant gas after compression formed therein to be in communication with the cylinder bores 31 via suction and discharge valves, respectively. An axial drive shaft 60 is arranged to axially extend through the center of the cylinder block 30, and rotatably supported by the cylinder block 30 and the front housing 40. A rotatable support 61 is mounted on the drive shaft 60 to be rotatable with the drive shaft 60. The rotatable support 61 is also axially supported by the front housing 40 via a thrust bearing 62. The rotatable support 61 has a support arm projecting into the crank chamber 31 and having an end thereof to which a race member 63 is fixed. The race member 63 movably supports a ball bearing 64 therein. The ball bearing 64 is provided with a through-bore formed therein to slidably receive an end of a guide pin 65. The other end of the guide pin 65 is fixed to an annular drive member 66 mounted around the drive shaft 60. A front spring 67, a cylindrical sleeve element 68, and a rear spring 69 are mounted on the drive shaft 60. The sleeve element 68 is slidable on the drive shaft 60, and is provided with a pair of trunnion pins 70 radially projecting therefrom in a direction perpendicular to the axis of the drive shaft 60. The ends of the pair of trunnion pins 70 are pivotally fitted in non-illustrated bores of the annular drive member 66, and thus the annular drive member 66 can be not only rotated with the drive shaft 60 but also pivoted on the trunnion pins 70 about an axis perpendicular to the axis of the drive shaft 60.

Figure 6:
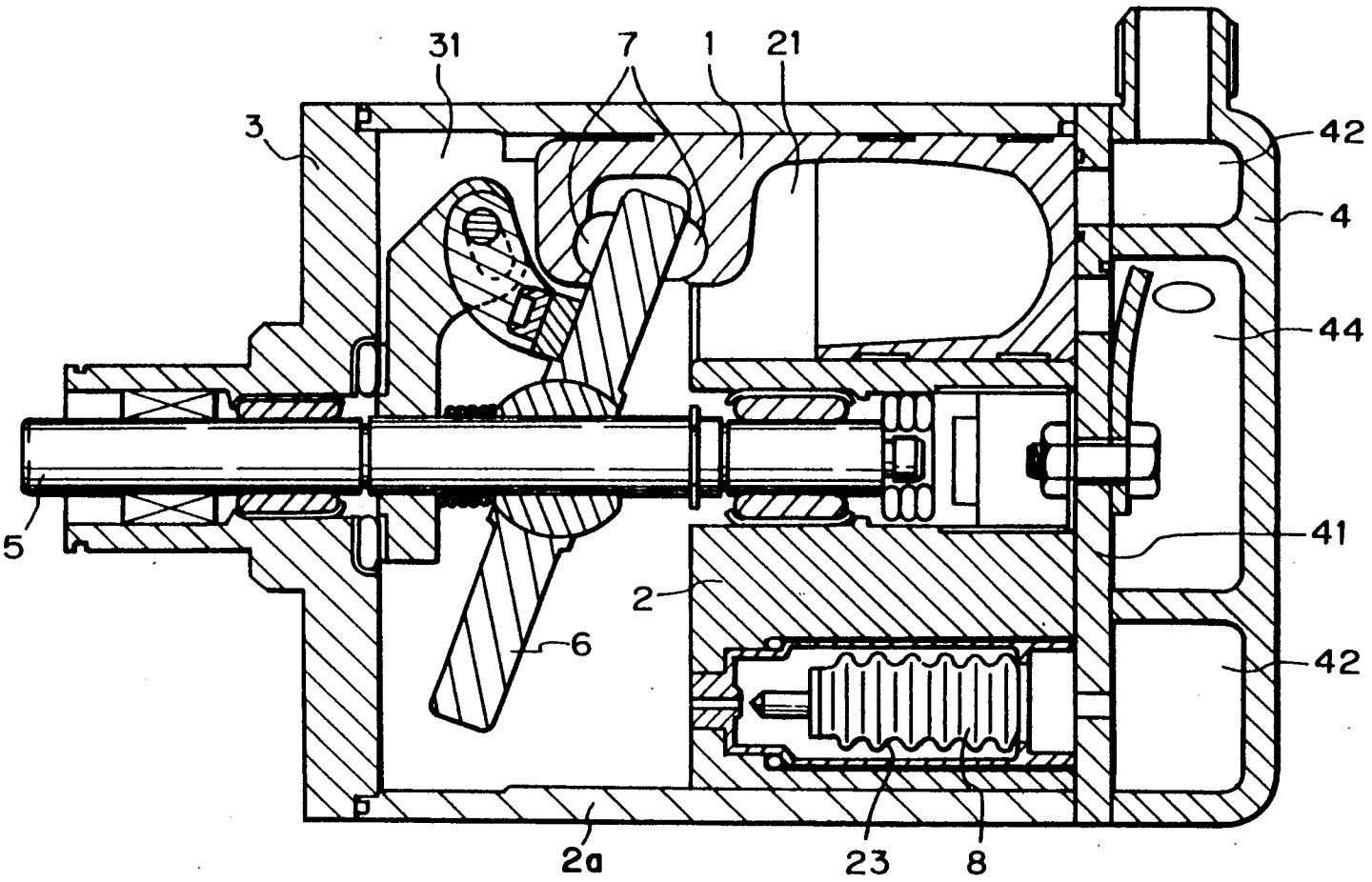
Fig. 6 (PRIOR ART)
FIG. 6 is a longitudinal cross-sectional view of a variable capacity swash plate type compressor according to a prior art.

A swash plate 71 is fixed to an end of the annular drive member 66 to be moved together with the annular drive member 66. Namely, the swash plate 71 can be rotated around the drive shaft 60, and pivoted on the trunnion pins 70 about the axis perpendicular to the axis of the drive shaft 60. The swash plate 71 is engaged with the above-mentioned reciprocatory pistons 10, via inner shoes 72 and outer shoes 73. Namely, when the swash plate 71 is rotated around the drive shaft 60, the reciprocating pistons 10 are reciprocated in the respective cylinder bores 31 of the cylinder block 30. Also, when a pressure differential between a pressure prevailing in the crank chamber 32 and a suction pressure of the compressor is changed, a piston stroke of the reciprocating pistons 10 is changed to thereby cause a change in a compression and delivery capacity of the compressor. When the piston stroke of the respective pistons 10 is changed, the swash plate 71 and the annular drive member 66 are pivoted to change an angle of inclination of the swash plate 71 with respect to a plane perpendicular to the axis of the drive shaft 60. It should be noted that the principle of the operation of the compressor of the present invention is similar to that of the prior art compressor of FIG. 6.

Figure 1:
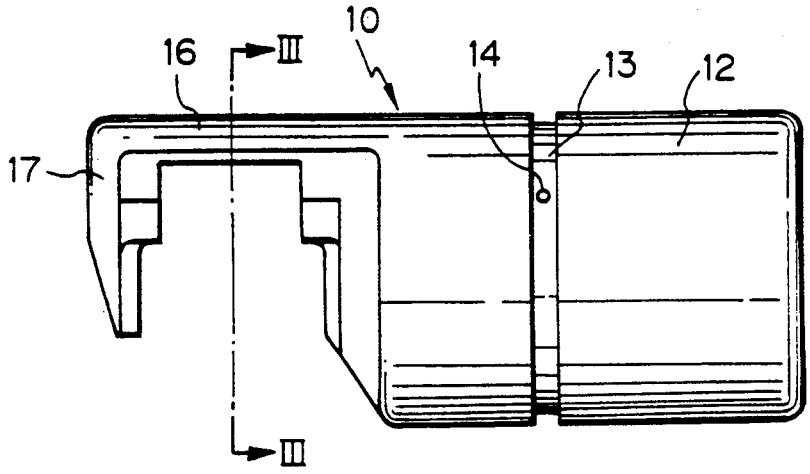
FIG. 1 is a side view of a piston according to an embodiment of the present invention.
Figure 2:
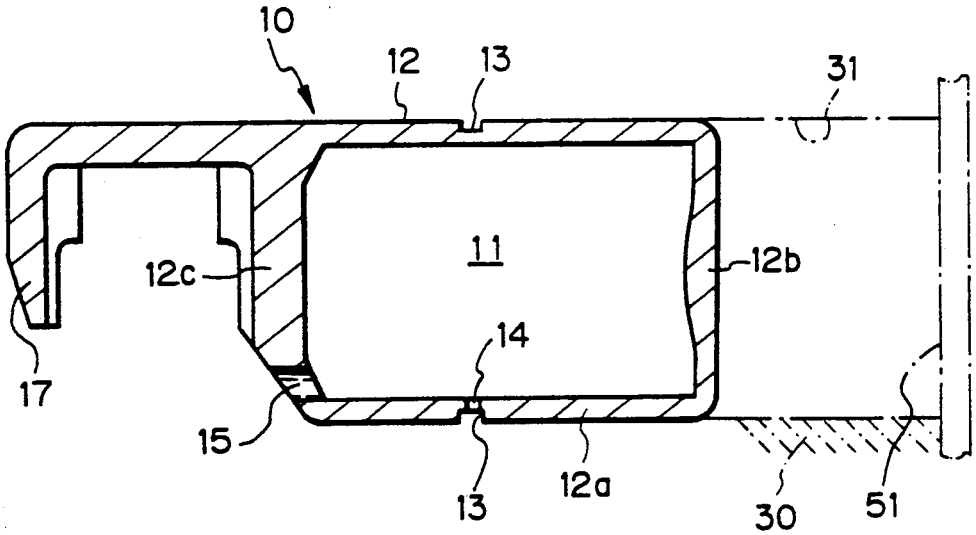
FIG. 2 is a longitudinal cross-sectional view of the piston of FIG. 1.
Figure 3:
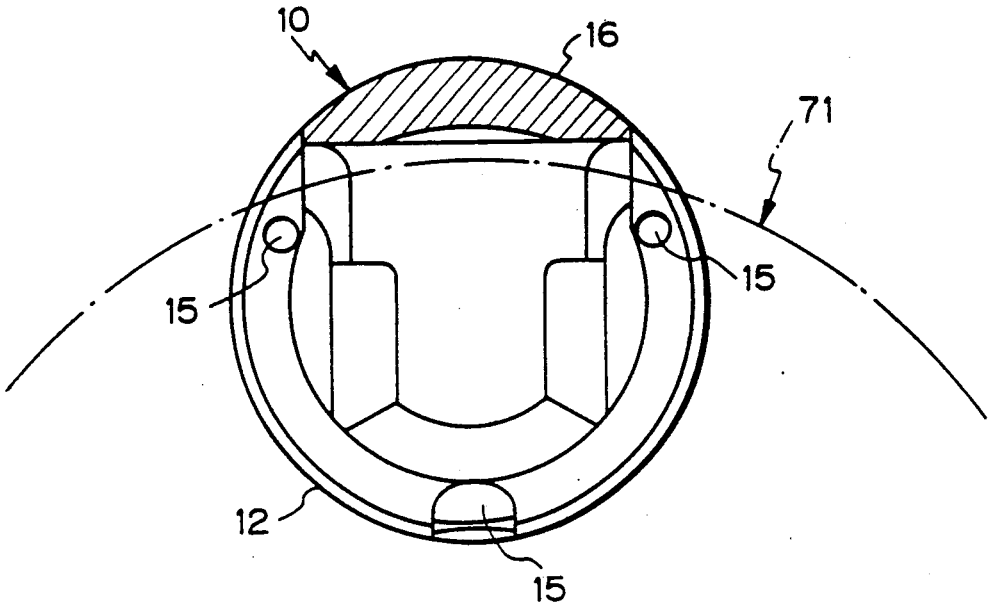
FIG. 3 is a cross-sectional view of the piston, taken along the line t III—III of FIG. 1, and illustrating a geometrical relationship between the piston and a swash plate of a variable capacity swash plate type compressor for which a plurality of the pistons is used.

Referring now to FIGS. 1 through 3, each of the reciprocatory pistons 10 accommodated in the variable capacity swash plate type refrigerant compressor illustrated in FIG. 5 is provided with an axially extended cylindrical main body 12 including a cylindrical hollow wall element 12*a*, first and second ends 12*b* and 12*c* closing axial ends of the cylindrical hollow wall element 12*a*. The piston 10 is also provided with an arm 16 axially extending from the second end 12*c* of the cylindrical main body 12 and having an engaging portion 17 formed at an end of the arm 16. The cylindrical hollow wall element 12*a* of the cylindrical main body 12 has a closed void 11 therein for reducing the wall thickness thereof, and that of the first and second ends 12*b* and 12*c*, to thereby reduce the weight of the piston 10. The cylindrical wall element 12*a* of the cylindrical main body 12 has an annular groove 13 formed in the outer surface thereof, for receiving a lubricating oil therein. The oil groove 13 of the cylindrical main body 12 is formed in a portion constantly located in the cylinder bore 31 of the cylinder block 30 during the reciprocation of the piston, and thus the oil groove 13 does not enter the crank chamber 32 even when the piston 10 is moved to a position shown in FIG. 2, i.e., a bottom dead center of the piston 10. The oil groove 13 of the cylindrical main body 12 has a bottom. thereof, and a plurality of, for example, three equiangularly arranged first through-bores 14 formed in the bottom for providing a fluid communication between outside the main body 12 and inside the main body 12, i.e., the above-mentioned closed void 11. Similarly, a plurality of, for example, three equiangularly arranged second through-bores 15 are formed in the second end 12*c* of the cylindrical main body 12 of the piston 10 for providing a fluid communication between inside the main body 12, i.e., the above-mentioned closed void 11 in the cylindrical wall element 12*a* and outside the main body 12 as shown in FIG. 3. The second through-bores 15 open toward the crank chamber 32 of the cylinder block 30.

The arm 16 of the piston 10 axially extends from the second end 12*c* and is provided with the afore-mentioned engaging portion 17 having an inner face axially facing and cooperating with the second end 12*c* to be operatively engaged with the periphery of the swash plate 71 (FIG. 5) via the shoes 72 and 73 (FIG. 5).

When the pistons 10 are incorporated in the compressor, each piston 10 is engaged with the swash plate 71 by the second end 12*c* and the engaging portion 17 thereof and is slidably fitted in the cylinder bore 31 of the cylinder block 30, and during the operation of the compressor, the cylindrical outer face of the main body 12 of the piston 10 is slid on the wall of the cylinder bore 31.

In the variable capacity swash plate type compressor including the above-mentioned reciprocatable pistons 10 therein, when the swash plate 71 is rotated by the drive shaft 60 (FIG. 5) to reciprocate each piston 10 in the cylinder bore 31 of the cylinder block 30, the refrigerant gas before compression enters the cylinder bore 31 from the suction chamber 52 (FIG. 5), and is compressed in the cylinder bore 31 by the first end 12*a* of each piston 10, acting as the compression end face of that piston 10. The compressed refrigerant gas is subsequently discharged from the cylinder bore 31 toward the discharge chamber 53 (FIG. 5).

During the reciprocation of the pistons 10, a pressure of the refrigerant gas prevailing in each of the cylinder bores 31 of the cylinder block 30 greatly varies from a low pressure level or a sub-pressure level to a very high pressure level, and vice versa. Namely, the hollow main body 12 of the piston 10 is necessarily subjected to great changes in the pressure of the refrigerant gas. Nevertheless, due to the provision of the afore-mentioned first through-bores 14 of the cylindrical main body 12, during the reciprocation of the piston 10, these through-bores 14 allow a breathing operation by permitting an alternate flow-in and flow-out of the refrigerant gas between the closed void 11 of the hollow main body of the piston 10 and the cylinder bore 31 of the cylinder block 30.

Simultaneously, a similar breathing operation is carried out by the piston 10 to permit an alternate flow-in and flow-out of the refrigerant gas between the closed void 11 of the hollow main body 12 and the crank chamber 32 of the cylinder block 30 through the second through-bores 15 to thereby assist a smooth occurrence of the afore-mentioned breathing operation between the void 11 and the cylinder bore 31. Therefore, a pressure differential between a pressure in the cylinder bore 31 and that in the closed void 11 of the piston 10 is reduced, and therefore, the cylindrical hollow wall element 12*a* of the hollow main body 12 of the piston 10 can be given a thin wall thickness while maintaining a sufficient physical durability against a pressure. Accordingly, the weight of the piston 10 can be lowered while retaining a high physical durability of the piston 10 against great pressure changes to which the piston is exposed. Namely, an improvement in the construction of a piston for a variable capacity swash plate type refrigerant compressor can be realized.

Further, when the pistons 10 are reciprocated in the cylinder bores 31 of the cylinder block 30, due to provision of the oil groove 13 of the cylindrical main body 12, the piston 10 can scrape and catch a lubricating oil component from the wall of the cylinder bore 31 to which the lubricating oil component contained in the refrigerant gas is attached. Therefore, during the aforementioned breathing operation of the piston 10 through the first and second through-bores 14 and 15, the refrigerant gas having suspended therein a sufficient amount of lubricating oil component enters both the closed void 11 of the main body 12 of the piston 10 and the crank chamber 32 of the cylinder block 30, and thus lubricates the internal movable elements of the compressor such as the swash plate 71 and shoes 72 and 73.

In the piston 10 according to the illustrated embodiment, the second through-bores 15 are arranged to axially open toward the shoes 72 and 73, and therefore, these shoes 72 and 73 can be supplied with a sufficient amount of lubricating oil by the flow of the oil suspended refrigerant gas from the closed void 11 of the piston through the second through-bores 15.

Figure 4:
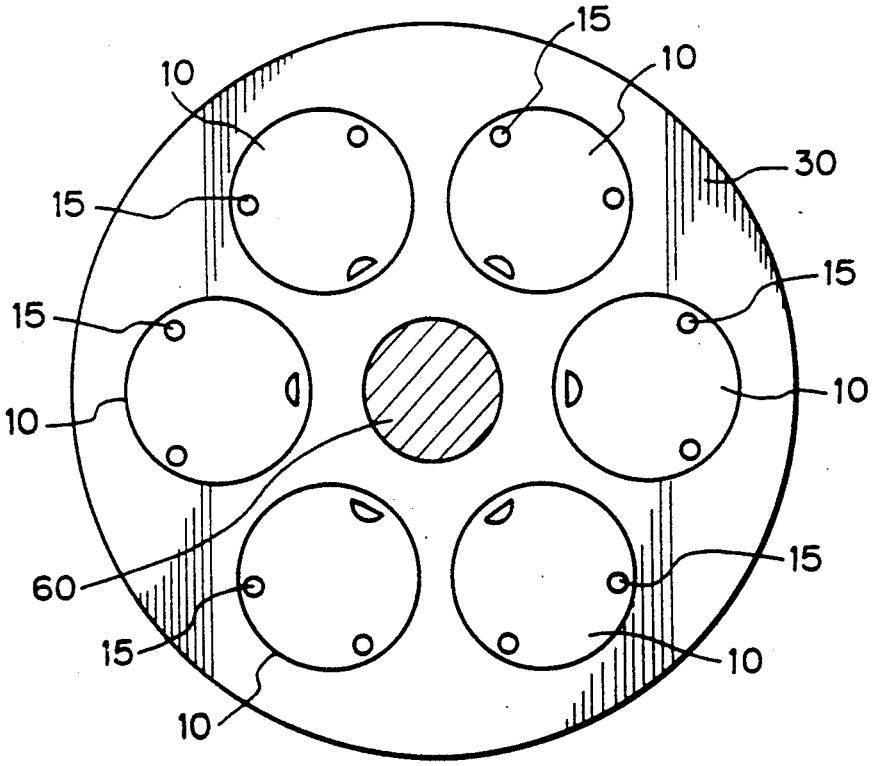
FIG. 4 is an end view of a cylinder block of a variable capacity swash plate type compressor and the pistons fitted in the cylinder block, illustrating an arrangement of the second bores formed in the pistons.

Furthermore, as illustrated in FIG. 4, when the compressor has six equiangularly arranged cylinder bores 31, and when the piston 10 has three equiangularly arranged second through-bores 15, the swash plate 71 and the shoes 72 and 73, which are apt to be made short of lubrication due to the operating attitude thereof, can be supplied with a sufficient amount of lubricating oil.

From the foregoing description, it will be understood that, in accordance with the present invention, a variable capacity refrigerant compressor can be provided with a plurality of hollow pistons each having a cylindrical main body defining therein a closed void enclosed by a thin wall formed with first and second through-bores to provide a fluid communication between the closed void of the piston and the outer environment of the piston. Therefore, the piston can be light in weight and have a sufficient physical durability against large pressure changes applied thereto. Further, the second through-bores of the piston opening toward the crank chamber of the compressor can contribute to a supply to the swash plate and the shoes of a sufficient amount of lubrication.

We claim:

1. A variable capacity swash plate type refrigerant compressor provided with an axially extended cylinder block having front and rear ends thereof and a plurality of axial cylinder bores formed therein, a front housing connected to the front end of the cylinder block and defining a sealed crank chamber therein extending in front of the front end of the cylinder block, a rear housing connected to the rear end of the cylinder block and defining therein a suction chamber for a refrigerant gas before compression and a discharge chamber for the refrigerant gas after compression, a drive shaft rotatably held by the cylinder block and the front housing to have an axis thereof axially extended through the crank chamber, a generally circular-shape swash plate mounted on the drive shaft to be rotatable therewith within the crank chamber and to be capable of turning about an axis perpendicular to the axis of the drive shaft, and a plurality of reciprocatory pistons fitted in the cylinder bores of the cylinder block and engaged with the swash plate via shoes, and a valve means for adjusting a fluid communication between the crank chamber and the suction chamber to control a capacity of the compressor through changing a pressure differential between the said crank and suction chambers, wherein each of said plurality of reciprocatory pistons comprises:

a cylindrical main body including an axially extended cylindrical wall member, a first end closing one axial end of the cylindrical wall member and acting as a compression end face of the reciprocatory piston, and a second end closing the other axial end of the cylindrical wall member and always facing the crank chamber, the cylindrical main body having a void therein, at least one first through-bore radially formed in the cylindrical wall member for providing a constant communication between the closed void and one of the plurality of cylinder bores in which the piston is fitted, and at least one second through-bore axially formed in the second end of the cylindrical wall member for providing a constant communication between the closed void and the crank chamber; and an engaging portion axially extended from the cylindrical main body for defining a recess for receiving a periphery of the circular swash plate and the shoes.

2. A variable capacity swash plate type refrigerant compressor according to claim 1, wherein said cylindrical wall member of said hollow cylindrical main body of said each piston is provided with an annular groove formed therein to define an annular chamber always communicated with corresponding said one cylinder bore, said first through-bore being arranged to provide a communication between said annular groove and said closed void of said cylindrical main body.

* * * * *